US006543629B1

(12) United States Patent
Samelson

(10) Patent No.: US 6,543,629 B1
(45) Date of Patent: Apr. 8, 2003

(54) DECORATIVE CURTAIN ROD END COVER

(75) Inventor: Samuel Samelson, New York, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

(21) Appl. No.: 09/960,426

(22) Filed: Sep. 24, 2001

(51) Int. Cl.[7] ..... A47H 1/02
(52) U.S. Cl. ..... 211/105.1
(58) Field of Search ..... 160/330, 38, 39, 160/19; 211/105.1, 105.3, 105.4, 123; 428/28

(56) References Cited

U.S. PATENT DOCUMENTS 706,539 A * 8/1902 Edgely ..... 211/105.1
1,374,026 A * 4/1921 Nelson ..... 211/105.1
1,837,340 A * 12/1931 Schwartz ..... 211/105.1
2,974,806 A * 3/1961 Seewack ..... 211/123
3,429,452 A * 2/1969 Johnson ..... 211/105.3
3,493,121 A * 2/1970 Doyle ..... 211/105.3
5,642,595 A * 7/1997 Daniels et al. ..... 160/330 X
5,670,221 A * 9/1997 Bried et al. ..... 428/28
5,678,703 A * 10/1997 Sawyer ..... 211/105.1
6,112,801 A * 9/2000 Daniels et al. ..... 160/330
6,302,180 B1 * 10/2001 Yu ..... 160/38

* cited by examiner

*Primary Examiner*—David M. Purol
(74) *Attorney, Agent, or Firm*—Robert L. Epstein; Harold James; James & Franklin, LLP

(57) ABSTRACT

The cover mounts over the end of a tension rod of the type which is used to mount window curtains or the like between opposing surfaces of a window recess. The cover is provided in mating parts which are assembled and joined together. The edges of the parts are provided with aligned pairs of protrusions and recesses adapted to frictionally engage to join the parts. Some of the protrusions are bifurcated with a circumferential flange for more positive engagement. To make the cover compatible with a smaller diameter rod, a split ring adapter collar can be situated between the rod and the neck of the cover.

23 Claims, 2 Drawing Sheets

DECORATIVE CURTAIN ROD END COVER

CROSS-REFERENCES TO RELATED APPLICATIONS

Not Applicable

STATEMENT REQUIRING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates to rods for mounting window curtains or shower curtains and more particularly, to a decorative cover for encircling the end of such a rod.

2. Description of the Related Art

Tension rods are commonly used for mounting bathroom window curtains between opposing surfaces of a window recess. The tension rod has two sections, one of which is telescopically received within the other. The sections are rotated relative to each other to permit the effective length of the rod to be adjusted.

Each section is provided with a rubber tip at the end so as not to mar the surface which it abuts. Rods of this type are commonly sold in ⅞ inch and 1 inch diameters and can be adjusted for use with a wide range of window recess sizes.

To install the rod between the opposing surfaces of the window recess, the rod sections are rotated to permit the length of the rod to be varied until the rubber tips of the ends of the rod bear tightly against the surfaces. As long as the friction between the rubber tips and the surfaces is greater than the force of gravity on the rod and curtain, the tension will hold the rod firmly in place.

A tension rod is a quick and easy curtain mounting device because it requires no mounting hardware that must be affixed to the wall, no installation tools and one size rod can be adjusted to accommodate a large range of different size window recesses. It takes only seconds to mount or remove and can be mounted and removed as many times as necessary. Due to the rubber tips, the rod does not mar the wall surfaces so that no patching or reconstruction of the wall surfaces is necessary after removal of the rod.

However, the rubber tips at the ends of the rod, usually the only visible part of the rod, tend to be unsightly. Accordingly, there is a need for an aesthetically pleasing cover to hide the ends of the rods. To be commercially successful, the cover should be easy to mount on the rod, before or after it is installed. Further, it should be usable with rods of both commonly encountered diameters.

Since one rod section is configured to be received within the other in telescoping fashion, the diameter of one rod section will be smaller than the other by the thickness of the section, for example, ⅛ in. It is desirable for the covers to fit snuggly on both sections, with no gap between the cover and the surface of the rod. Accordingly, the invention includes an adapter collar which mounts over the rod and fits between the cover and the rod surface to eliminate the gap. Preferably, the adapter collars are flexible enough to permit the covers to accommodate variations in rod diameter such that the covers can be used to fit all commonly available rods.

Further, the covers of the present invention can be used on pre-existing non-tension type shower curtain rods as well. Those rods are generally affixed directly to the shower enclosure wall by means of brackets. In that case, the covers enclose the brackets. The covers function in the exact same manner, regardless of the type of rod involved.

It is, therefore, a prime object of the present invention to provide a decorative cover for the end of a curtain rod.

It is another object of the present invention to provide a decorative curtain rod end cover that is easy to mount, either before or after the curtain rod is installed.

It is another object of the present invention to provide a "one-size-fits-all" decorative curtain rod end cover.

It is another object of the present invention to provide a decorative curtain rod end cover that can be fabricated in a wide variety of different styles and colors.

BRIEF SUMMARY OF THE INVENTION

In accordance with the present invention, a decorative cover for the end of a curtain rod is provided. The cover includes first and second mating cover parts. Means are provided for joining the cover parts such that they encircle the rod end.

The cover part joining means includes at least one protrusion extending form the edge of one of the cover parts adapted to align with a recess in the edge of the other of the cover parts. The protrusion frictionally engages the recess. Preferably, the cover part joining means includes more than one protrusion/recess pair.

In order to provide more positive engagement between the cover parts, one or more of the protrusions is bifurcated such that the parts are inclined away from each other and squeezed together when received in the recess. A tapered circumferential flange may also be provided to facilitate insertion of the protrusion and further enhance the frictional engagement.

An adapter collar is situated between the exterior surface of the rod and the interior of the cover. The collar is received within the neck section of the cover part.

The adapter collar is made of flexible plastic. It has a split ring configuration which permits it to fit over the rod and adjust to a variety of rod diameters.

BRIEF DESCRIPTION OF THE SEVERAL VIEWS OF THE DRAWINGS

To these and to such other objects which may hereinafter appear, the present invention relates to a decorative curtain rod end cover, as described in detail in the following specification, recited in the annexed claims and illustrated in the accompanying drawings, in which like numerals refer to like parts and in which:

DETAILED DESCRIPTION OF THE DRAWINGS

Figure 1:
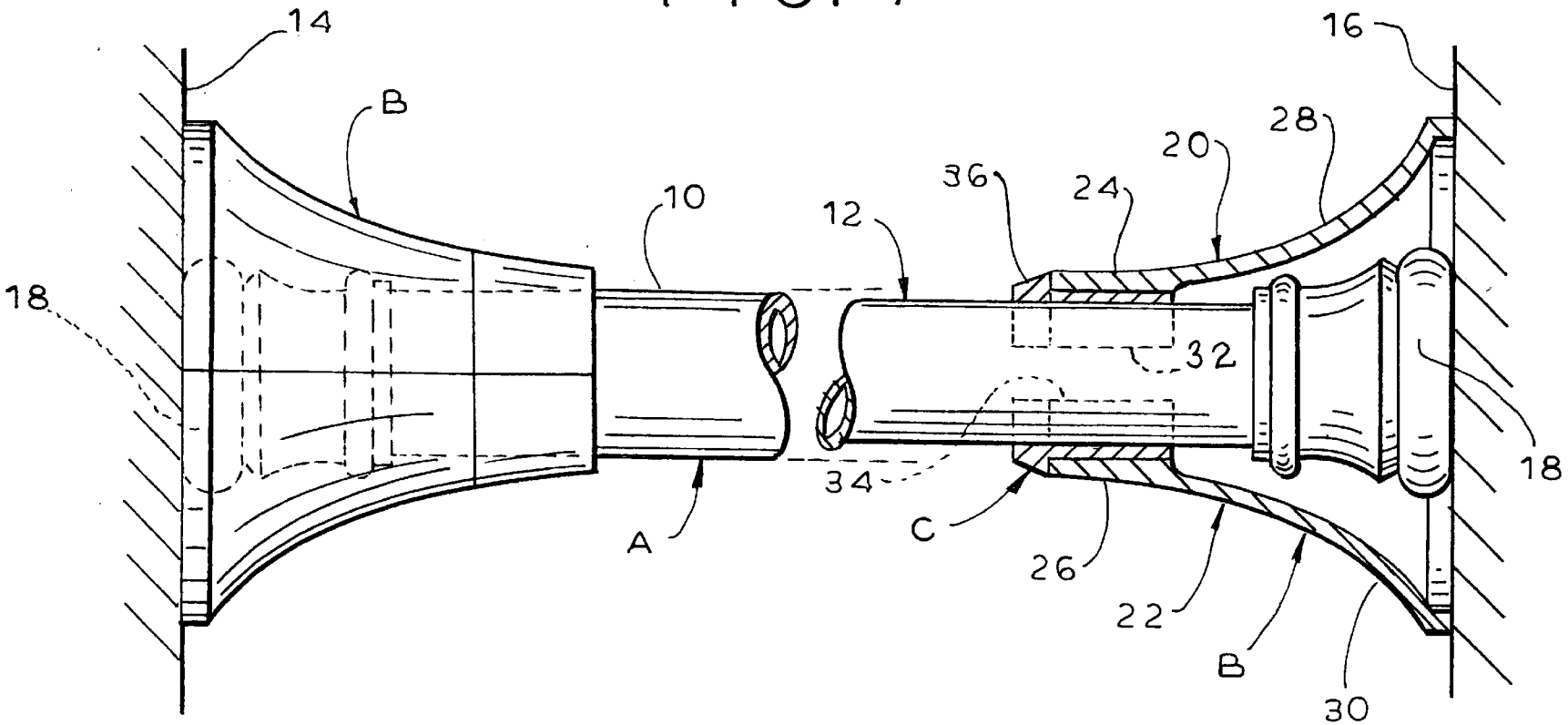
FIG. 1 is a side view of a tension rod as it would appear installed in a window recess with a preferred embodiment of the cover of the present invention mounted on each end, one of which is shown in cross-section so as to show the adapter collar.

As seen in FIG. 1, the conventional tension rod, generally designated A, has two hollow sections 10, 12. Section 12 has a slightly smaller diameter than section 10 such that it can be telescopically received within section 10. The sections can be rotated relative to each other to permit the effective length of the rod to be adjusted to snuggly fit between opposing surfaces 14, 16 of a window recess or the like. Each end of rod A has a rubber tip 18 which abuts the adjacent surface 14, 16.

Figure 2:
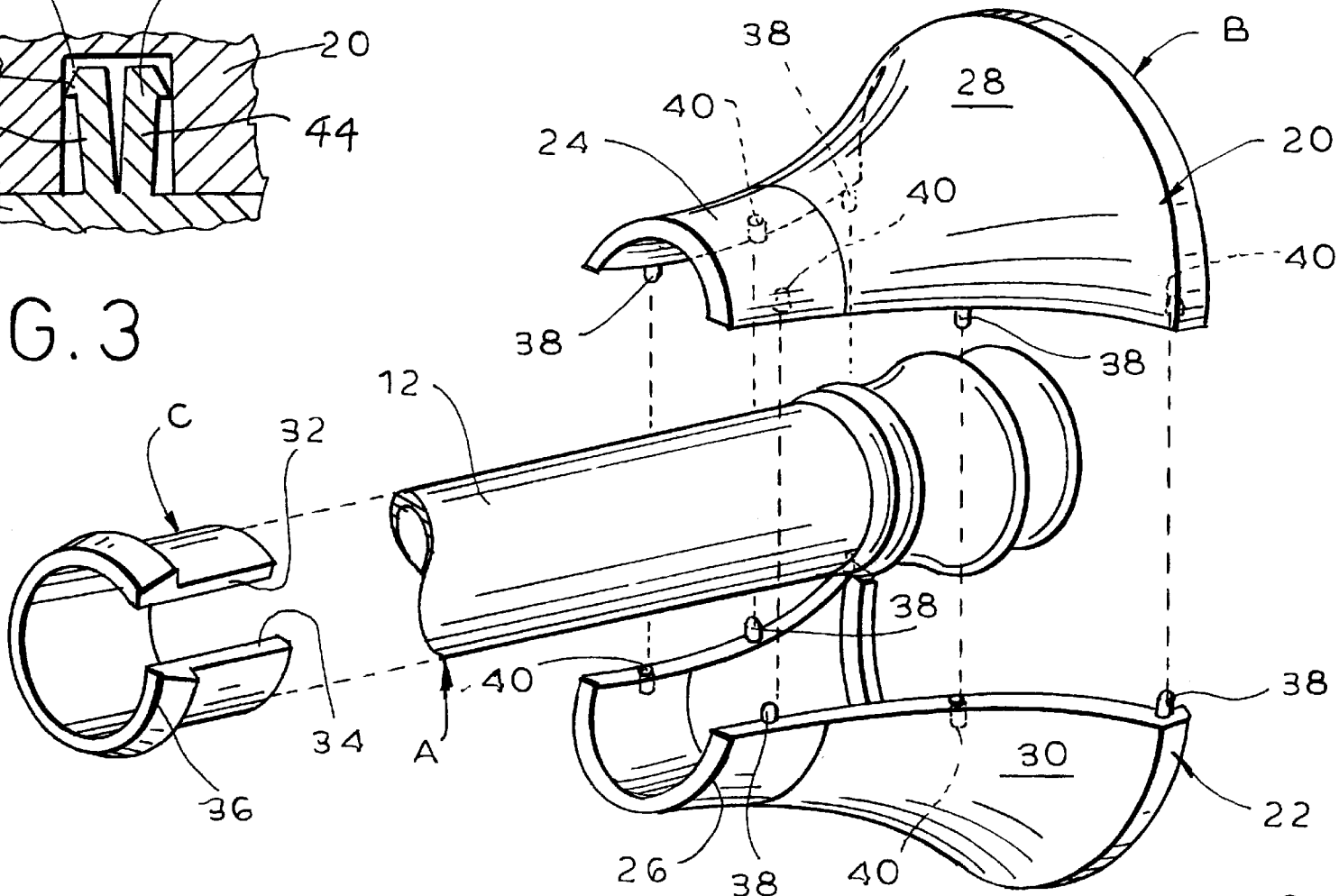
FIG. 2 is an exploded isometric view of the preferred embodiment of the present invention.

As best seen in FIG. 2, the cover, generally designated B, is provided in two parts 20, 22, preferably mirror image halves. Each part 20, 22 has a neck section 24, 26, respectively, and a body section 28, 30, respectively.

Because the covers B have the same inner diameter, an adapter collar, generally designated C, may be used to fill the gap between the external surface of the smaller diameter rod section 12 and the interior surface of neck 24, 26 of the cover.

Collar C has a split ring configuration and is fabricated of flexible plastic such that the edges 32, 34 of the collar can be spread apart to mount the collar over the rod. Once situated on the rod, the collar is moved into position between the surface of the rod and the interior of the neck of the cover, as seen in FIG. 1.

Preferably, collar C is provided with an external tapered circumferential flange 36 which acts both as an insertion stop means to prevent the collar from being inserted too far into the cover and as an aesthetically pleasing finishing member for the end of the cover.

Tension rods are commonly manufactured in ⅞ inch and 1 inch outer diameters. While it is possible to manufacture the cover of the present invention in two sizes, one for each diameter rod, it is preferable to fabricate the cover in a "one-size-fits-all" manner. The cover parts assemble such that the neck sections 24, 26 have an inner diameter of about one inch, to accommodate the 1 inch diameter rod. Adapter collars can be used when the covers are used on a rod of smaller diameter.

The cover parts 20, 22 are preferably made of plastic and are injection molded. However, they could also be composed of resin, sculptured into the desired shape.

The cover parts 20, 22 are joined together by one or more protrusions 38 extending from the edge of one cover part and one or more recesses 40 in the edge of the other cover part. Parts 20 and 22 are aligned such that the protrusions 36 are received in and frictionally engage the recesses 40, permitting the cover parts to "snap-fit" together.

Figure 3:
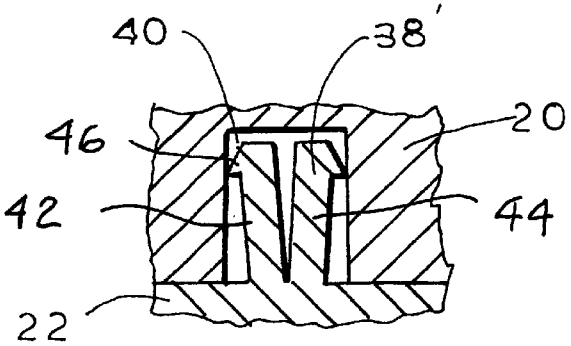
FIG. 3 is an enlarged view of one of the protrusion/recess pairs of the present invention.

As seen in FIG. 3, some of the protrusions 38' are bifurcated with parts 42, 44 made of flexible plastic which are normally inclined away from each other. When received within a recess 40, parts 42, 44 are squeezed together so as to increase the amount of friction between the protrusion parts and the recess wall.

Preferably, the protrusions have a tapered circumferential flange 46 which facilitates the squeezing of the parts together as the protrusion is inserted into the recess. The flange also concentrates the outward force applied by the parts on the recess wall to enhance the frictional engagement.

Cover A can be mounted on a rod before it is installed or can be mounted on an already installed rod. Thus, they can be supplied with the tension rod when it is purchased or separately for mounting on already installed rods of various types.

Any shape or decorative design may be used for the exterior of the cover. The body sections of the parts can be generally conical or concave in shape, as shown in FIGS. 1 and 2, or generally convex in shape. In either case, the end of the cover is open to permit the end of the rod to bear directly against the wall surface.

It will now be appreciated that the present invention relates to a decorative curtain rod end cover which encircles and hides the rod end. The cover is fabricated in mating mirror image parts which are joined together by protrusions which frictionally engage recesses along the edges of the cover parts. An adapter collar is provided such that a single size cover can be used in a wide variety of different situations.

While only a preferred embodiment of the present invention has been disclosed for purposes of illustration, it is obvious that many variations and modifications thereof are possible. It is intended to cover all of these variations and modifications which fall within the scope of the present invention, as defined by the following claims:

I claim:

1. A decorative cover for the end of a certain rod of the type in which the end is adapted to abut a surface, said cover comprising first and second mating cover parts, each of said cover parts comprising an open-ended body section, and means for joining said cover parts such that said body sections form an open-ended enclosure proximate the end of the rod.

2. The cover of claim 1 wherein said cover part joining means comprises a protrusion extending from the edge of one of said cover parts and a recess in the edge of the other of said cover parts, said protrusion being adapted to frictionally engage said recess, when said cover parts are aligned.

3. The cover of claim 2 wherein said cover part joining means comprises more than one protrusion/recess pair.

4. The cover of claim 2 wherein one of said protrusions is bifurcated.

5. The cover of claim 4 wherein said bifurcated protrusion comprises a circumferential flange.

6. The cover of claim 5 wherein said flange is tapered.

7. The cover of claim 1 further comprising an adapter collar adapted to be received between the rod and the cover.

8. The cover of claim 7 wherein said collar has a split ring configuration.

9. The cover of claim 7 wherein said collar comprises a circumferential flange.

10. The cover of claim 9 wherein said flange is tapered.

11. The cover of claim 7 wherein said collar comprises means for preventing the collar from being inserted too far into the cover.

12. The cover of claim 7 wherein said collar comprises means for finishing the end of the cover.

13. A decorative cover for the end of a curtain rod comprising first and second mating cover parts and means for joining said cover parts to encircle the rod end, said cover part joining means comprising a bifurcated protrusion extending from the edge of one of said cover parts and a recess in the edge of the other of said cover parts, said protrusion being adapted to frictionally engage said recess, when said cover parts are aligned.

14. The cover of claim 13 further comprising an adapter collar adapted to be received between the rod and the cover.

15. The cover of claim 14 wherein each of said cover parts has a neck section and wherein said collar is situated within said neck sections.

16. A decorative cover for the end of a certain rod of the type in which the end is adapted to abut a surface, said cover comprising first and second mating cover parts, each of said cover parts comprising an open-ended body section, and means for joining said cover parts such that said body sections form an open-ended enclosure proximate the end of the rod and an adapter collar adapted to be received between the rod and said cover.

17. The cover of claim 16 wherein said collar has a split ring configuration.

18. In combination, a curtain rod having an end adapted to abut a surface and a decorative cover, said cover comprising first and second meting cover parts, each of said cover ports comprising an open-ended body section, and means for joining said cover parts such that said body sections form an open-ended enclosure proximate the end of the rod.

19. The combination of claim 18 further comprising an adapter collar adapted to be received between said rod and said cover.

20. The combination of claim 19 wherein said collar has a split ring configuration.

21. A decorative cover for the end of a curtain rod comprising first and second mating covers parts and means for joining said cover parts to encircle the rod end, said cover part joining means comprising a protrusion extending from the edge of one of said cover parts and a recess in the edge of the other of said cover parts, said protrusion being adapted to frictionally engage said recess, when said cover parts are aligned, wherein said protrusion is bifurcated.

22. The cover of claim 21 wherein said bifurcated protrusion comprises a circumferential flange.

23. The cover of claim 22 wherein said flange is tapered.

* * * * *